US006540163B1

(12) United States Patent
Huang

(10) Patent No.: US 6,540,163 B1
(45) Date of Patent: Apr. 1, 2003

(54) WATER SPRAY PISTOL

(76) Inventor: Dustin Huang, No. 2, Yung-Feng Lane, Hsin-Pao Village, Fang-Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/261,910

(22) Filed: Oct. 2, 2002

(51) Int. Cl.[7] ..... B05B 15/08

(52) U.S. Cl. ..... 239/587.5; 239/587.1; 239/280.5; 239/532; 239/530; 239/525; 285/184; 285/282

(58) Field of Search ..... 239/525, 526, 239/530, 532, 587.1, 587.2, 587.5, 587.6, 588, 280, 280.5, 71, 73; 285/184, 185, 272, 276, 277, 282

(56) References Cited

U.S. PATENT DOCUMENTS 3,893,630 A * 7/1975 Bochmann et al. ..... 239/587.5

6,216,965 B1 * 4/2001 Chao ..... 239/587.4

* cited by examiner

*Primary Examiner*—Michael Mar
*Assistant Examiner*—Darren Gorman
(74) *Attorney, Agent, or Firm*—Harrison & Egbert

(57) ABSTRACT

A water spray pistol includes a barrel, an elbow pipe fastened to the barrel, a pivoting seat fastened to the elbow pipe, and a nozzle head fastened to the pivoting seat. The pivoting seat is provided with a pivoting shaft and a locating pin. The nozzle head has a pivoting portion which is provided with a series of locating slots and an angle scale. The pivoting portion of the nozzle head is pivotally mounted on the pivoting shaft. As the pivoting portion makes a turn on the pivoting shaft, the locating pin of the pivoting seat is retained in one of the locating slots of the pivoting portion of the nozzle head, so as to locate securely the nozzle head. The angular adjustment of the nozzle head is measured by the angle scale of the pivoting portion.

1 Claim, 7 Drawing Sheets

WATER SPRAY PISTOL

RELATED U.S. APPLICATIONS

Not applicable.

STATEMENT REGARDING FEDERALLY SPONSORED RESEARCH DEVELOPMENT

Not applicable.

REFERENCE TO MICROFICHE APPENDIX

Not applicable.

FIELD OF THE INVENTION

The present invention relates generally to a water spray pistol, and more particularly to an adjustable nozzle head of the water spray pistol.

BACKGROUND OF THE INVENTION

The water spray pistol is commonly used for gardening and washing objects. The conventional spray pistol comprises a barrel, a hand grip, a control lever, and a nozzle head. The nozzle head is fastened angularly and fixedly to the top end of the barrel. In other words, the nozzle head of the conventional water spray pistol cannot be angularly adjusted, thereby resulting in a great deal of inconvenience in the usage of the conventional water spray pistol.

BRIEF SUMMARY OF THE INVENTION

The primary objective of the present invention is to provide a water spray pistol which is free of the deficiency of the conventional water spray pistol described above.

In keeping with the principle of the present invention, the foregoing objective of the present invention is attained by the water spray pistol comprising a hand grip, a control lever, a barrel, an elbow pipe, a pivoting seat, and a nozzle head having a pivoting portion. The elbow pipe is fastened at one end with the barrel, and at the other end with the pivoting seat which is provided at the center of one side thereof with a pivoting shaft for fastening pivotally the pivoting portion of the nozzle head. The pivoting seat is eccentrically provided in the one side thereof with a locating pin, while a pivoting portion of the nozzle head is provided in one side with a plurality of locating slots corresponding in location to the locating pin of the pivoting seat. As the nozzle head is angularly adjusted, the locating pin of the pivoting seat is removably retained in one of the locating slots of the pivoting portion of the nozzle head, so as to locate securely the nozzle head in the wake of being angularly adjusted. The nozzle head can be angularly adjusted in a step-by-step manner, thanks to the locating slots which are arranged at an interval along the one side of the pivoting portion of the nozzle head. The pivoting portion of the nozzle head is provided in other side with an angle scale and a pointer.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
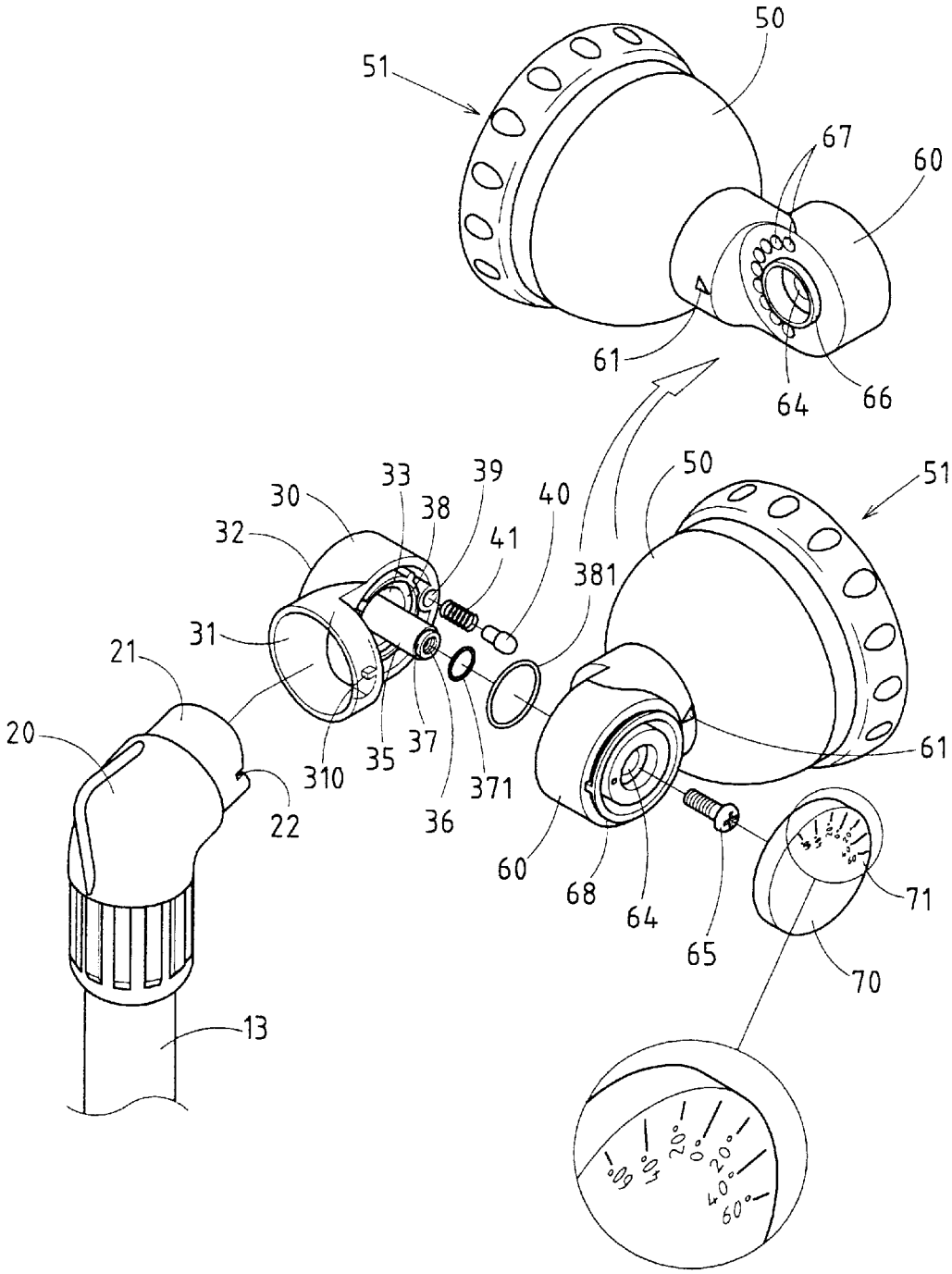
FIG. 1 shows an exploded perspective view of the preferred embodiment of the present invention.
Figure 2:
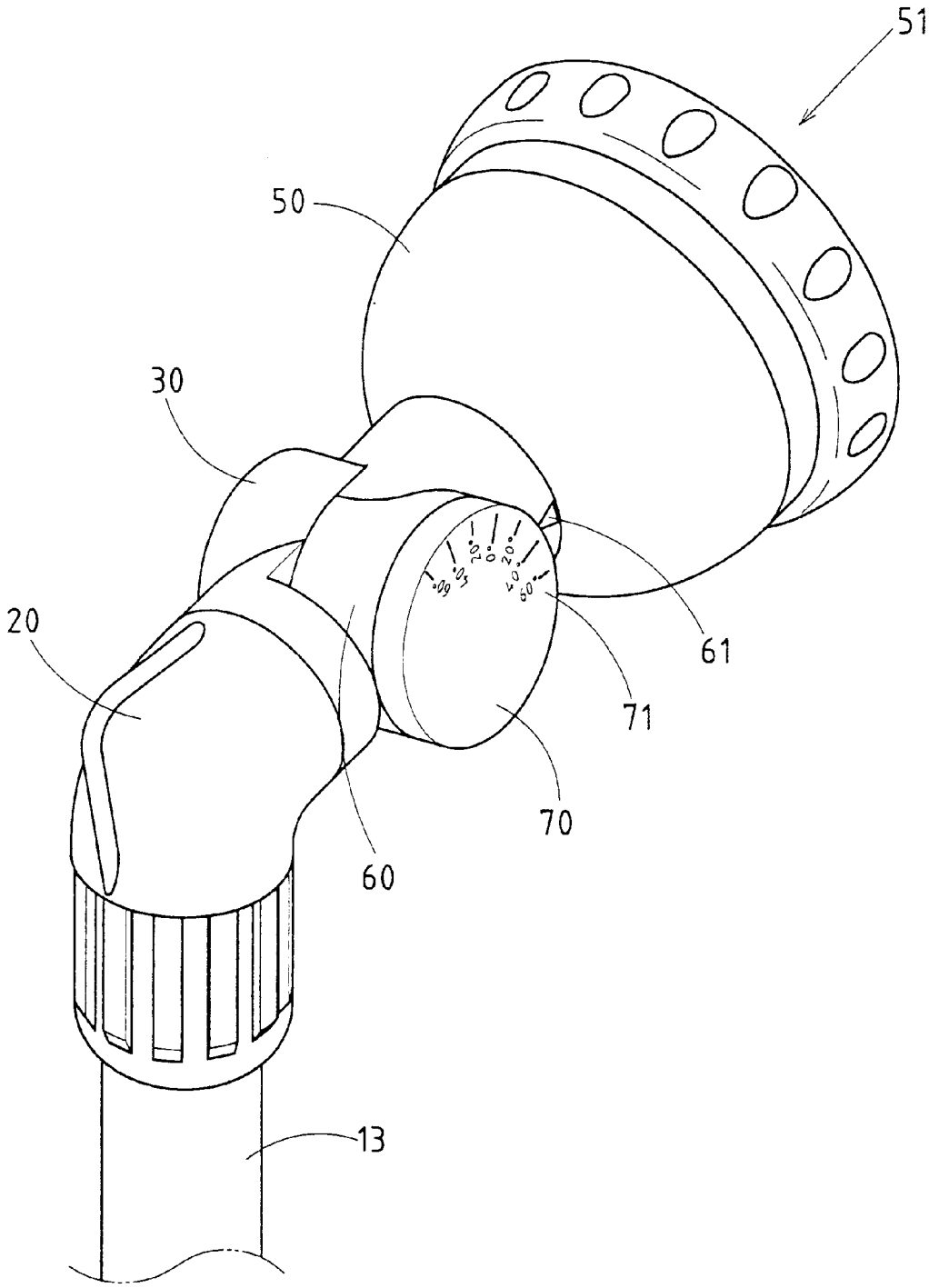
FIG. 2 shows a perspective view of the preferred embodiment of the present invention.

As shown in FIGS. 1–4, a water spray pistol 10 embodied in the present invention comprises a hose connector 11, a hand grip 12, a barrel 13, an elbow pipe 20, a pivoting seat 30, and a nozzle head 50.

The hose connector 11 is fastened with the bottom end of the hand grip 12 which is in turn fastened at the top end thereof with the bottom end of the barrel 13.

The elbow pipe 20 is fastened at one end with the top end of the barrel 13 and is provided at the other end with a fastening portion 21.

The pivoting seat 30 is formed of a fastening member 31 and a pivoting member 32. The fastening member 31 is fastened with the fastening portion 21 of the elbow pipe 20. The pivoting member 32 is provided with a recess 33 which is provided in the side wall with a through hole 34 in communication with a duct of the elbow pipe 20. The recess 33 is provided at the center of the bottom wall with a pivoting shaft 35 of a predetermined length and extending therefrom. The pivoting shaft 35 is provided at the free end with a threaded hole 36 of a predetermined depth and extending in the longitudinal direction of the pivoting shaft 35. The pivoting shaft 35 is further provided in the outer wall of the free end thereof with a shoulder 37 and a washer 371 fitted with the shoulder 37. The pivoting seat 30 is further provided in the recess 33 with a circular groove 38 and a washer 381 disposed in the circular groove 38. The pivoting seat 30 is provided eccentrically with a retaining slot 39 in which a spring 41 and a locating pin 40 are disposed such that the locating pin 40 is urged by the spring 41.

The nozzle head 50 has an outer end which is provided with a plurality of jet nozzles 51. The nozzle head 50 further has a pivoting portion 60 which is opposite to the outer end of the nozzle head 50 and is provided in the interior with a water cell 62. The cell 62 has an inner end in communication with the recess 33 of the pivoting seat 30. The cell 62 is provided in one side wall with a through hole 63 in communication with the jet nozzles 51 of the nozzle head 50. The cell 62 is provided in the center with a through hole 64 dimensioned to enable the pivoting shaft 35 of the pivoting seat 30 to be put therethrough. The pivoting portion 60 is mounted on the pivoting shaft 35 of the pivoting seat 30 in conjunction with a fastening bolt 65 which is engaged with the threaded hole 36 of the pivoting shaft 35. In the meantime, an annular protrusion 66 of the pivoting portion 60 presses against the washer 381 of the circular groove 38 of the pivoting seat 30. The pivoting portion 60 is further provided in one side with a series of locating slots 67 which are arranged at an interval and are corresponding in location to the locating pin 40 of the pivoting seat 30. The pivoting portion 60 is further provided in other side with a pointer 61 and a retaining portion 68 for retaining a cover 70 which is provided with an angle scale 71 for measuring an angular adjustment of the nozzle head 50 in conjunction with the pointer 61.

Figure 9:
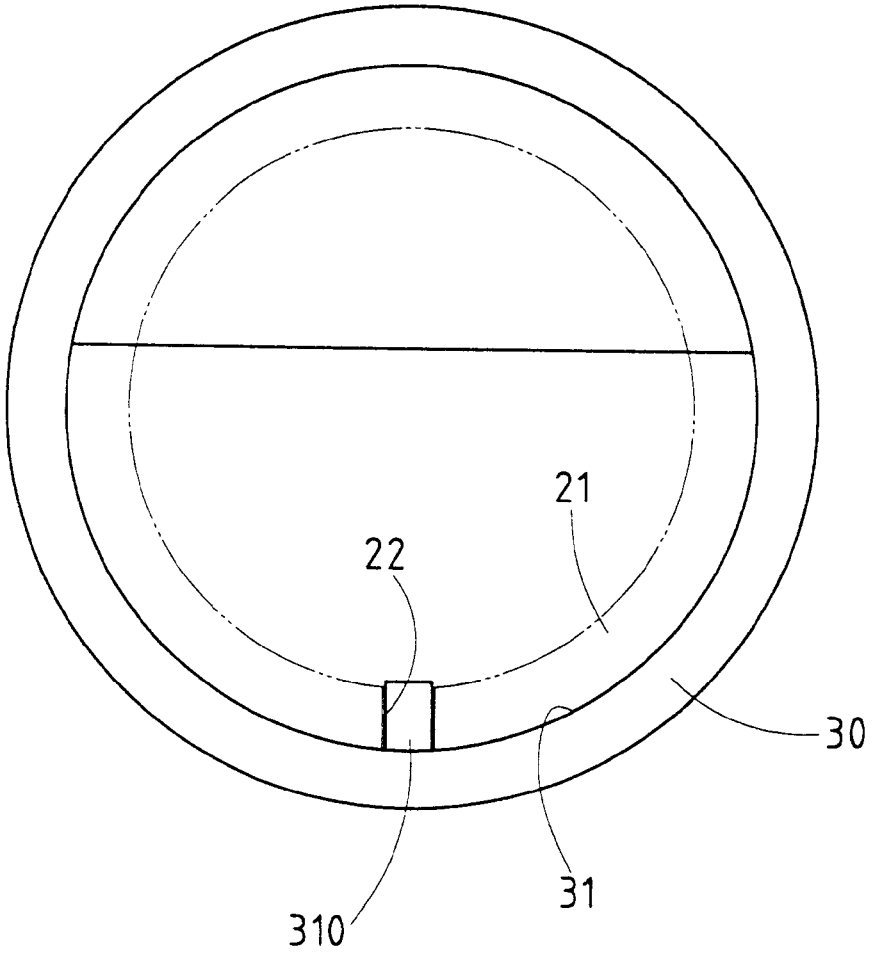
FIG. 9 shows a cross-sectional view of the fastening of the elbow pipe with the pivoting seat of the preferred embodiment of the present invention.

As shown in FIG. 9, the fastening portion 21 of the elbow pipe 20 is provided with at least one retaining slot 22, while the fastening member 31 of the pivoting seat 30 is provided with a retaining projection 310. The fastening portion 21 of the elbow pipe 20 is fastened with the fastening member 31 of the pivoting seat 30 such that the retaining projection 310 of the pivoting seat 30 is retained in the retaining slot 22 of the elbow pipe 20, thereby preventing the pivoting seat 30 from turning in relation to the elbow pipe 20.

Figure 3:
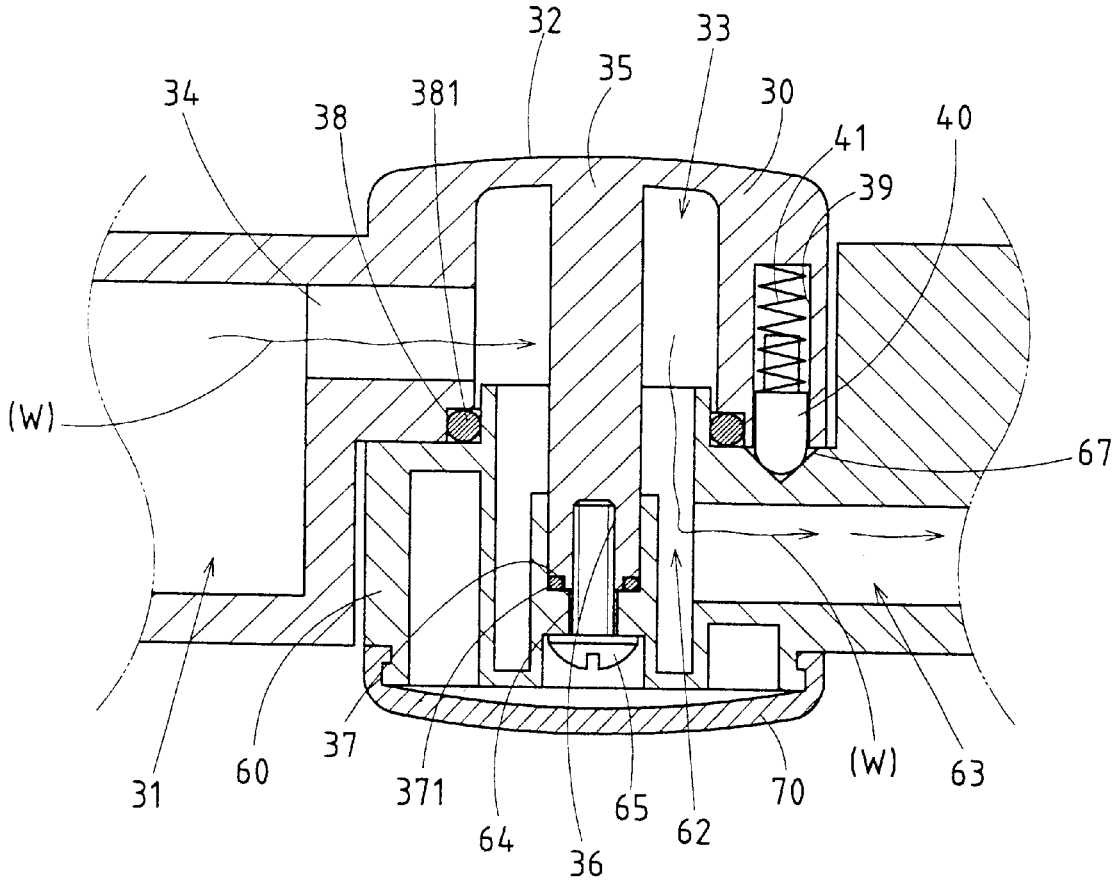
FIG. 3 shows a sectional view of the pivoting seat and the pivoting portion of the nozzle head of the preferred embodiment of the present invention.
Figure 4:
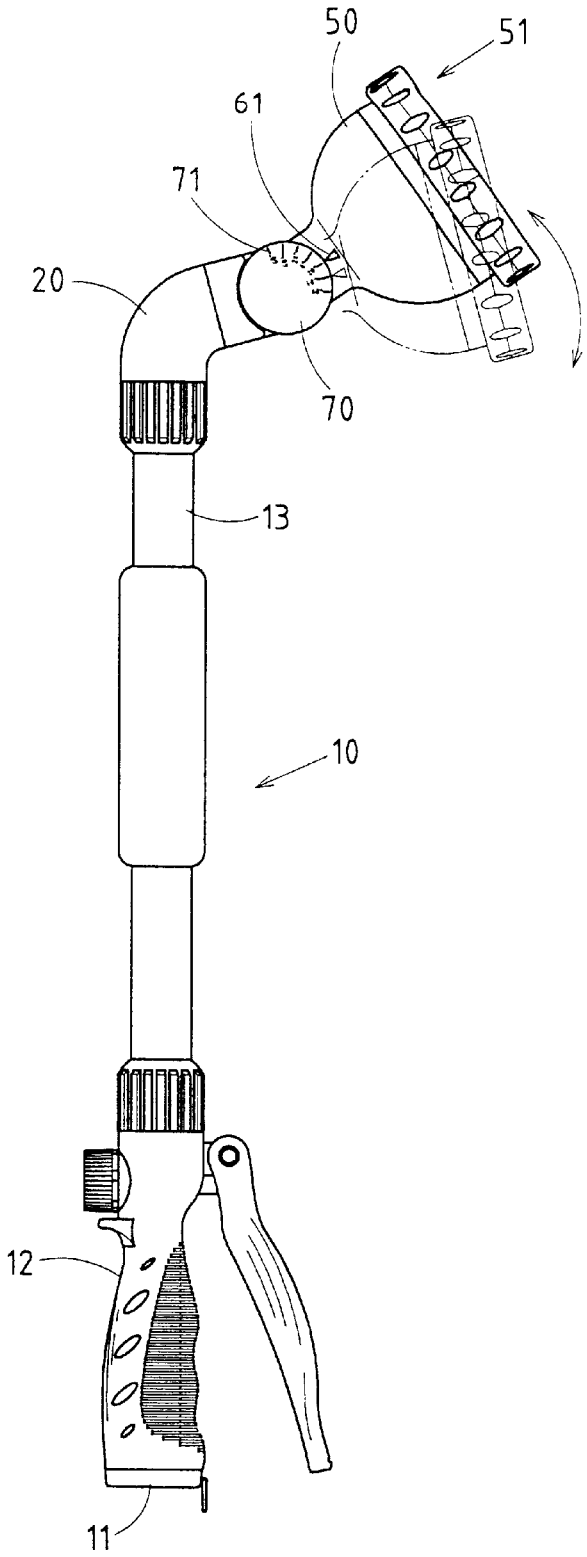
FIG. 4 shows a side schematic view of a water spray pistol of the present invention in its entirety.
Figure 5:
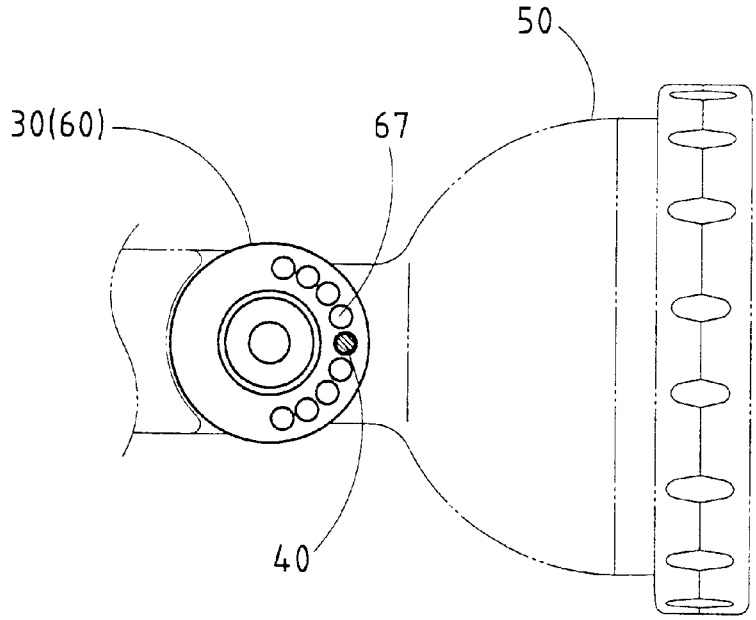
FIG. 5 shows a schematic view of the working relationship between the pivoting seat and the pivoting portion of the nozzle head of the preferred embodiment of the present invention.
Figure 6:
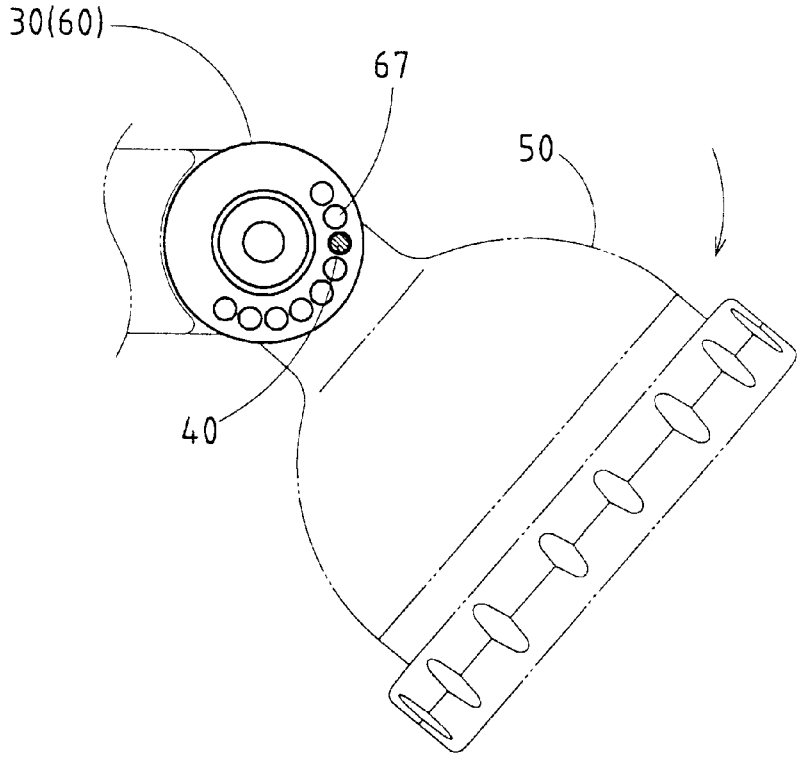
FIG. 6 shows another schematic view of the working relationship between the pivoting seat and the pivoting portion of the nozzle head of the preferred embodiment of the present invention.
Figure 7:
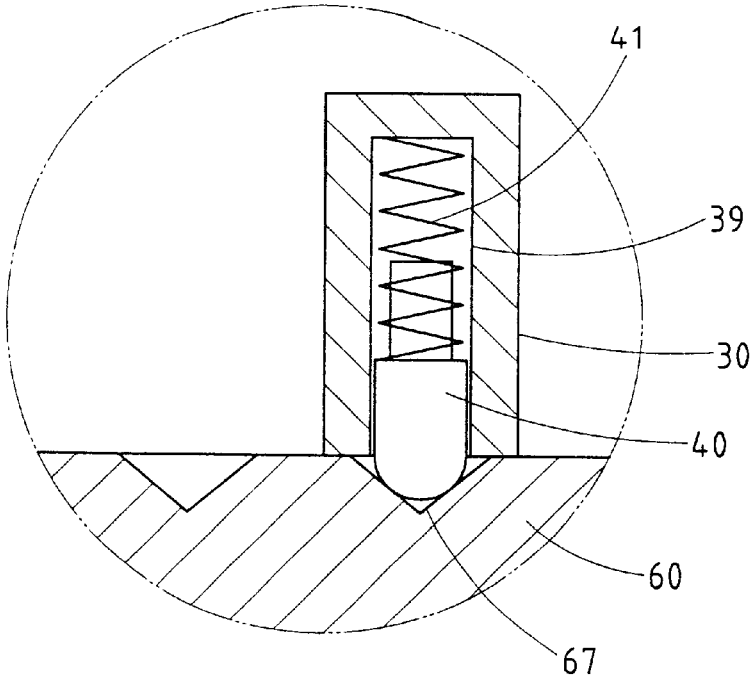
FIG. 7 shows a sectional view of the engagement of the locating pin with the locating slot of the preferred embodiment of the present invention.
Figure 8:
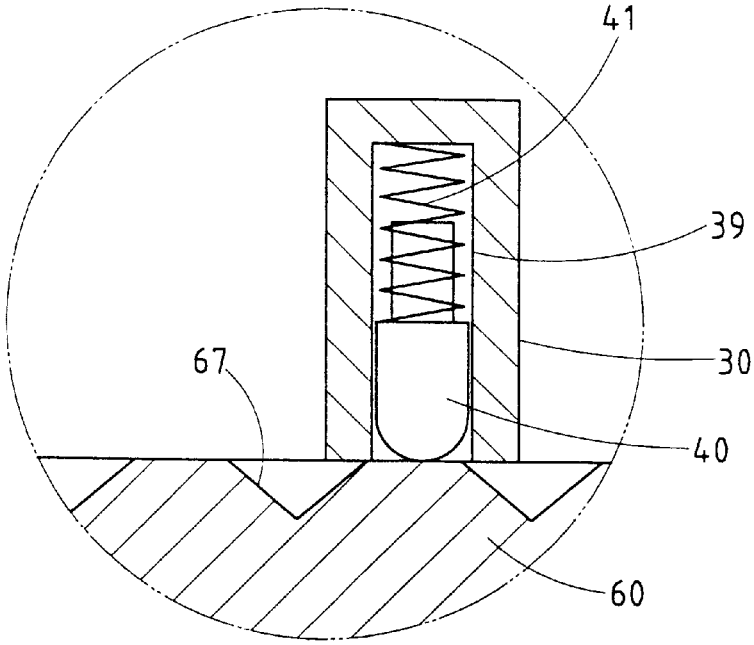
FIG. 8 shows a sectional view of the disengagement of the locating pin with the locating slot of the preferred embodiment of the present invention.

As illustrated in FIG. 3, water "W" is emitted by the jet nozzles 51 of the nozzle head 50 via the through hole 63 of the side wall of the cell 62 of the pivoting portion 60 of the nozzle head 50, the recess 33 of the pivoting seat 30, the through hole 34 of the bottom wall of the recess 33, and the duct of the elbow pipe 20. By virtue of the circular groove 38, the washer 3 81, the annular protrusion 66, and the washer 371, the pivoting portion 60 of the nozzle head 50 is pivotally fastened with the pivoting seat 30 in an airtight manner. As the nozzle head 50 is angularly adjusted, the pivoting portion 60 of the nozzle head 50 turns on the pivoting shaft 35 of the pivoting seat 30. The angular adjustment of the nozzle head 50 is measured by the angle scale 71 in conjunction with the pointer 61, as illustrated in FIG. 4. In the meantime, the locating pin 40 of the pivoting seat 30 moves from the locating slots 67 of the pivoting portion 60 of the nozzle head 50 into another one of the locating slots 67, as illustrated in FIGS. 5–8. The nozzle head 50 is thus located securely at that new by the combined effort of the locating pin 40 and the locating slot 67.

The embodiment of the present invention described above is to be construed in all respects as being illustrative and nonrestrictive. Accordingly, the present invention may be embodied in other specific forms without deviating from the spirit thereof. The present invention is therefore to be limited only by the scope of the following appended claim.

I claim:

1. A water spray pistol comprising:

a barrel;

a hand grip fastened at a top end to a bottom end of said barrel and provided at a bottom end with a hose connector;

an elbow pipe fastened at one end to a top end of said barrel and provided at another end with a fastening portion;

a pivoting seat comprised of a fastening member and a pivoting member, with said fastening member being fastened to said fastening portion of said elbow pipe, said pivoting member being comprised of a recess which is provided in a side wall with a through hole in communication with a duct of said elbow pipe, said recess further provided at a center of a bottom wall with a pivoting shaft extending therefrom and having at a free end thereof a threaded hole extending in the longitudinal direction of said pivoting shaft; and a nozzle head provided at an outer end with a plurality of jet nozzles, and at an inner end with a pivoting portion which is provided in an interior with a cell in communication with said jet nozzles, said cell being comprised of a through hole, said pivoting portion of said nozzle head being pivotally mounted on said pivoting shaft of said pivoting seat in conjunction with a fastening bolt such that said fastening bolt is engaged with said threaded hole of said pivoting shaft, and that said cell of said pivoting portion is in communication with said recess of said pivoting seat, and that said pivoting portion turns on said pivoting shaft;

wherein said fastening portion of said elbow pipe is comprised of at least one retaining slot; wherein said fastening member of said pivoting seat is comprised of at least one retaining projection whereby said retaining projection is retained in said retaining slot of said fastening portion of said elbow pipe for preventing said pivoting seat from turning in relation to said elbow pipe;

wherein said pivoting seat is provided in said recess thereof with a circular groove and a washer disposed in said circular groove; wherein said pivoting shaft of said pivoting seat is provided in an outer wall of the free end thereof with a shoulder and a washer fitted with said shoulder;

wherein said pivoting seat is eccentrically comprised of a retaining slot, a spring disposed in said retaining slot, and a locating pin disposed in said retaining slot such that said locating pin is urged by said spring; wherein said pivoting portion of said nozzle head is provided in one side with a series of locating slots for retaining said locating pin of said pivoting seat in the wake of a turn that said pivoting portion of said nozzle head makes on said pivoting shaft of said pivoting seat;

wherein said pivoting portion of said nozzle head is provided in another side with a cover, and a pointer contiguous to said cover whereby said cover is provided in an outer side with an angle scale for measuring an angular adjustment of said nozzle head in conjunction with said pointer.

* * * * *